US008920065B2

(12) United States Patent
Storey et al.

(10) Patent No.: US 8,920,065 B2
(45) Date of Patent: Dec. 30, 2014

(54) VEHICLE BARRIER SYSTEMS AND ASSEMBLIES

(75) Inventors: Kenneth Lewis Storey, Armuchee, GA (US); Charles R. Coleman, Armuchee, GA (US); Chad Garrett Heimbecker, Allentown, PA (US)

(73) Assignee: S. I. Storey Lumber Co., Inc., Armuchee, GA (US)

( * ) Notice: Subject to any disclaimer, the term of this patent is extended or adjusted under 35 U.S.C. 154(b) by 896 days.

(21) Appl. No.: 12/609,758

(22) Filed: Oct. 30, 2009

(65) Prior Publication Data

US 2010/0111603 A1 May 6, 2010

Related U.S. Application Data

(60) Provisional application No. 61/109,711, filed on Oct. 30, 2008.

(51) Int. Cl.
*E01F 13/00* (2006.01)
*E01F 15/00* (2006.01)
*E01F 15/04* (2006.01)

(52) U.S. Cl.
CPC ..... *E01F 15/0453* (2013.01)
USPC ..... 404/6; 256/13.1

(58) Field of Classification Search
USPC ..... 404/6, 9, 10; 40/608, 612; 256/13.1
See application file for complete search history.

(56) References Cited

U.S. PATENT DOCUMENTS

| | | | | |
|---|---|---|---|---|
| 5,022,782 | A * | 6/1991 | Gertz et al. | 404/6 |
| 5,462,258 | A * | 10/1995 | Gaillard et al. | 256/13.1 |
| 5,503,495 | A * | 4/1996 | Mak et al. | 404/6 |
| 6,558,067 | B2 * | 5/2003 | Ochoa | 404/6 |
| 7,182,320 | B2 * | 2/2007 | Heimbecker et al. | 256/13.1 |
| 7,249,908 | B2 * | 7/2007 | Bergendahl et al. | 404/6 |
| 7,544,009 | B2 * | 6/2009 | Bergendahl et al. | 404/6 |
| 2004/0140460 | A1 * | 7/2004 | Heimbecker et al. | 256/13.1 |
| 2006/0102883 | A1 * | 5/2006 | Troutman et al. | 256/13.1 |
| 2008/0230759 | A1 * | 9/2008 | Lass et al. | 256/13.1 |

FOREIGN PATENT DOCUMENTS

FR 2900941 A1 * 11/2007

* cited by examiner

*Primary Examiner* — Abigail A Risic
(74) *Attorney, Agent, or Firm* — Thomas|Horstmeyer, LLP

(57) ABSTRACT

A vehicle barrier system, comprising, a support member having a first side disposed toward an area used by vehicles, a splice plate including a support aperture and a stress concentrator associated with to the support aperture, and a rail assembly including, in one embodiment, a wood rail and a first side, wherein the first side of the rail assembly is coupled to the splice plate and the splice plate is coupled to the support member at the support aperture. In another embodiment the rail assembly includes one or more weakened areas serving as stress concentrators in the rail assembly.

21 Claims, 4 Drawing Sheets

VEHICLE BARRIER SYSTEMS AND ASSEMBLIES

This application claims the benefit of and priority to U.S. Provisional Patent Application No. 61/109,711, filed Oct. 30, 2008 entitled "Vehicle Barrier Systems and Assemblies" which is incorporated by reference in its entirety as if fully set forth herein.

BACKGROUND

The present disclosure relates to vehicle barrier systems and assemblies. A vehicle barrier assembly typically includes one or more horizontal rails, connected to support members that are fixed to the ground. The rails of the assembly are generally made of metal bar elements, which are assembled together to ensure continuity. In the event of an impact from a vehicle, the vehicle barrier assembly absorbs kinetic energy from the vehicle as it comes to a stop. The combination of support members and rails allows the assembly to reach the strength required to withstand and/or absorb the forces of an impacting vehicle.

SUMMARY

Embodiments of the present disclosure are related to vehicle barrier systems and assemblies.

Briefly described, one embodiment, among others, comprises a system. The system comprises: a support member having a first side adapted for disposition toward an area used by vehicles; a splice plate including a support aperture; and a rail assembly including a rail, optionally a backing member, and a first side; wherein the first side of the rail assembly is coupled by way of the splice plate to the support member at the support aperture. One or more stress concentrators can be included in either the splice plate, associated with its support aperture, or in the rail assembly or both. The stress concentrator(s) are operative to weaken the area in the splice plate and/or in the rail assembly associated with the stress concentrator(s). Thus, for example, when a vehicle impacts a section of the system, the applied force or load may induce a designed and intended failure in either the coupling of the rail assembly to the support member or in the rail member to absorb and dissipate the force of impact of the vehicle on the system. In this way, for example, a portion of the kinetic energy from an impacting vehicle is dissipated by the de-coupling of the rail assembly from the support member and/or by the deformation of the rail assembly which is free to deform away from the support member.

Another embodiment, among others, comprises a system. The system comprises: a support member having a first side adapted for disposition toward an area used by vehicles; and a rail assembly including a rail member and having a first side and having a first end and a second end opposite its first end, the first side of the rail assembly being coupled to the support member; wherein the system further includes one or more of: a splice plate including a support aperture and a stress concentrator associated with the support aperture for coupling the rail assembly to the support member at the support aperture; a weakened location in between the first end and the second end of the rail member serving as a stress concentrator therein; or an anchor coupled to the rail assembly between the first end and the second end of the rail assembly and an anchor tension loading member with a first end coupled to the anchor and a second end coupled to the support member.

Another embodiment, among others, comprises a system. The system comprises: a support member having a first side adapted for disposition toward an area used by vehicles; a splice plate including a support aperture and a stress concentrator associated with the support aperture; and a rail assembly including a rail, optionally a backing member, and a first side; wherein the first side of the rail assembly is coupled to the splice plate and the splice plate is coupled to the support member at the support aperture. The rail assembly may be coupled to the first side of the support member via the splice plate. In a further embodiment, the rail is comprised of wood.

Another embodiment, among others, comprises a system. The system comprises: a first support member; a second support member; and a rail assembly including a rail, a first side and a weakened location located on the rail assembly between a first end and a second end thereof, in which the rail assembly is coupled at or near its first end to the first support member and at or near its second end to the second support member. In a further embodiment, the rail assembly is coupled to either or both of the first and second support members by a splice plate including a support aperture and a stress concentrator associated with the support aperture, the splice plate being coupled at its support aperture. In yet a further embodiment the rail is comprised of wood.

Another embodiment, among others, comprises a system. The system comprises: a first support member; a second support member; a wooden rail assembly including a wooden rail and optionally a backing member disposed on a first side of the wooden rail; an anchor coupled to the wooden rail assembly, and optionally to the backing member, between a first and a second end of the wooden rail assembly; and an anchor tension loading member with a first end coupled to the anchor and a second end coupled to the first support member; in which the wooden rail assembly is coupled at or near its first end to the first support member and at or near its second end to the second support member. In a further embodiment, the wooden rail is coupled to either or both of the first and second support members by a splice plate including a support aperture and a stress concentrator associated with the support aperture, the splice plate being coupled at its support aperture.

Another embodiment, among others, comprises a system. The system comprises a vehicle barrier system including an end assembly, the end assembly including: a plurality of support members, for example a first support member and a second support member; a wooden rail assembly including a wooden rail and optionally a metal backing member disposed on the first side of the wooden rail; an anchor coupled to the wooden rail, or if present the backing member, between a first and a second end of the wooden rail assembly; an anchor tension loading member with a first end coupled to the anchor and a second end coupled to the first support member; the wooden rail assembly being coupled at or near its first end to the first support member and at or near its second end to the second support member. The end assembly may further be coupled to a center assembly, the center assembly comprising at least one additional rail assembly coupled at or near one of its ends to an additional support member and coupled at or near its opposite end to the second support member of the end assembly, wherein the end assembly is setback at an angle relative to the center assembly. In a further embodiment, at least one of the wooden rails includes one or more weakened locations. In yet a further embodiment at least one rail assembly is coupled to at least one of the support members by a splice plate including a support aperture and a stress concentrator associated with the support aperture, the splice plate being coupled at its support aperture.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
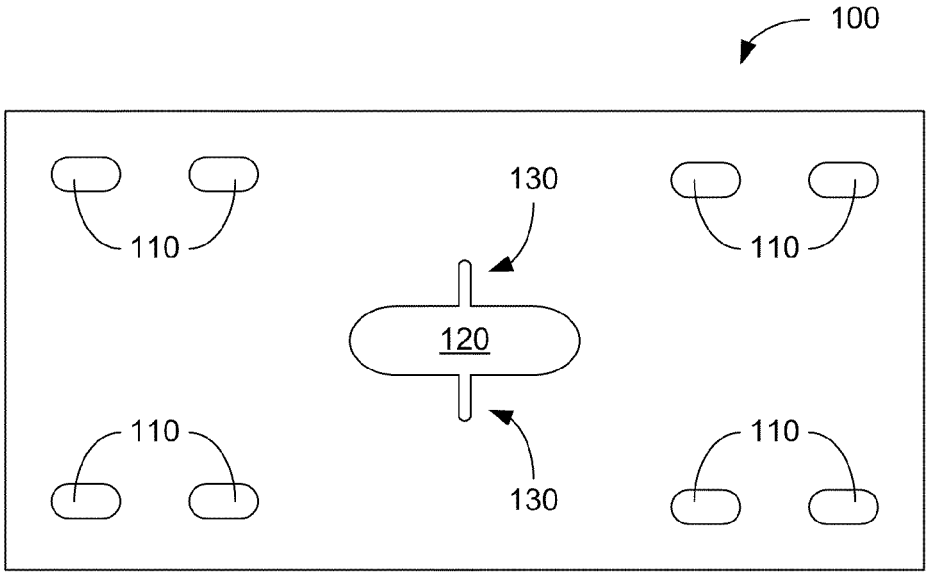
FIG. 1 is a depiction of a splice plate in accordance with an embodiment of the present disclosure.

Disclosed herein are various embodiments of systems and apparatus related to vehicle barriers. Reference will now be made in detail to the description of the embodiments as illustrated in the drawings, wherein like reference numbers indicate like parts throughout the several views.

In general, vehicle barrier systems are located near areas used by vehicles and include support members and rail assemblies which are attached to the support members. The rail assemblies may be attached to the support members using an intermediate member such as, but not limited to, a splice plate. FIG. 1 is a depiction of an exemplary embodiment of a splice plate 100 of the present disclosure. In this embodiment, the splice plate 100 includes rail apertures 110, that may be used to couple the splice plate 100 to a rail or a rail assembly.

The splice plate 100 also incorporates one or more support apertures 120 used to couple the splice plate 100 to a support member (such as support member 210 described below). In one embodiment, as depicted in FIG. 1, splice plate 100 includes support aperture 120. A stress concentrator 130 is associated with support aperture 120 in the splice plate 100. The stress concentrator 130 is operative to weaken the area around the support aperture 120 allowing a fastener (such as support fastener 310 described below in relation to FIG. 3), which is attached to the support member, to pull through the aperture 120. This arrangement allows the fastener to pull though the splice plate 100 when sufficient load or force is applied. For example, when a vehicle impacts a section of a vehicle barrier system, the applied force may separate a rail assembly from a support member by pulling the fastener through the support aperture 120 by assistance from the stress concentrator 130. In this way, a portion of the energy from an impacting vehicle is dissipated by the fastener pulling though the aperture 120 and the subsequent deformation of the rail assembly which is free to deform away from the support member. Splice plates 100 may be composed of materials such as, but not limited to, any one or more of a metal (for example, iron, stainless steel, carbon steel, aluminum, brass, and other like metals), wood, a polymeric material (for example, high density polyethylene, low density polyethylene, and other polymers), a steel reinforced material, a banded material or a fiber composite material.

Notably, although the stress concentrator 130 is depicted in FIG. 1 as in communication with the support aperture 120, the stress concentrator may take other forms. In another embodiment, a stress concentrator may be one or more slots or one or more additional apertures associated with, located adjacent or near, but not necessarily in communication with, the support aperture 120. The stress concentrator may also be one or more trenches or kerfs located on one or both sides of the splice plate 100, a trench being similar to a slot, except that a trench only penetrates a portion of the thickness of the splice plate 100. In another embodiment the stress concentrator 130 may be located on a single side of the support aperture or may be staggered on opposite sides, rather than aligned across from each other. Stress concentrations are not limited to those described above and include other forms of stress concentrators. In yet another embodiment, the stress concentrator 130 includes multiple slots, trenches or kerfs, or a combination of slots, trenches, kerfs or other stress concentrators, for example two stress concentrators (as illustrated in FIG. 1) or more. The arrangement of stress concentrators 130, as depicted in FIG. 1, may be opposite each other, above and below the support aperture. In other embodiments the stress concentrators 130 of FIG. 1 may be in other arrangements, including but not limited to, on either side of the support aperture, both on one side of the support aperture, or other arrangement in which the stress concentrators are or are not opposite each other. Additionally, the trenches, slots, kerfs and other stress concentrators may be perpendicular to the aperture or they may be at any other angle to the support aperture 120.

Figure 2:
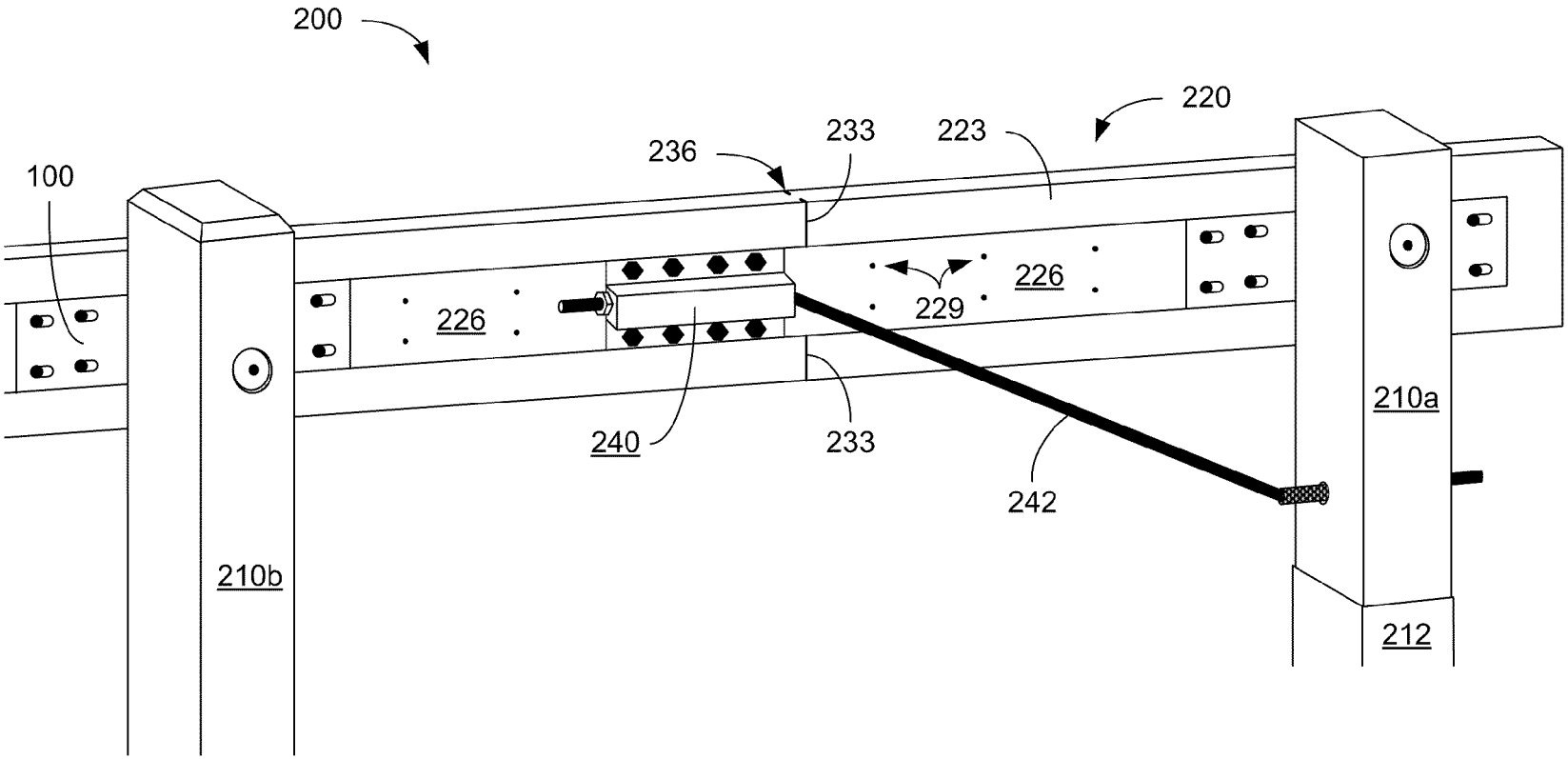
FIG. 2 is a depiction of a vehicle barrier system including the splice plate of FIG. 1 in accordance with an embodiment of the present disclosure.

FIG. 2 is a depiction of a vehicle barrier system 200 including the splice plate 100 of FIG. 1 in accordance with an embodiment of the present disclosure. In the embodiment of FIG. 2, the vehicle barrier system 200 includes a plurality of support members 210 *a, b* and a rail assembly 220. In the exemplary embodiment, rail assembly 220 includes a rail member 223 and a backing member 226. The rail member 223 may a have side facing an area used by vehicles and another side facing the support members 210 *a, b*. Rail members may be composed of, but are not limited to, any one or more of wood, timber, synthetic wood, plastic, concrete, a resin reinforced composite or a metal. The backing members may be composed of, but are not limited to, a metal (for example, iron, stainless steel, carbon steel, aluminum, brass, and other like metals), wood, a polymeric material (for example, high density polyethylene, low density polyethylene, and other polymers), a steel reinforced material, a banded material or a fiber composite material.

The backing member 226 may be coupled to the rail member 223 with rail assembly fasteners 229. In the embodiment of FIG. 2, the backing member 226 is depicted as being coupled to the rail member 223 with fasteners 229 which include, but are not limited to, lag screws, nails, thru-bolts, staples, rivets, and wood screws. In other embodiments, the backing member 226 may be coupled to the rail 223 by other methods, including but not limited to welding, adhesives, crimping, and threading or stitching the backing member to the rail.

In an exemplary embodiment one or more backing members 226 may run longitudinally along the length of the rail assembly 220. Backing members 226, however, are optional and need not be included at all or may be included only along a portion of the rail assembly 220. A backing member 226 may span a plurality of rail members 223 of a rail assembly 220. Alternatively a backing member 226 may be limited to a single rail member 223. As depicted in FIG. 2, backing member 223 runs along a length of rail member 223 up to splice plate 100.

One or more weakened locations may be included in the rail member 223. Weakened locations may be stress concentrators in a rail member to weaken it at a predetermined location. They are designed to aid and initiate fracture of the rail member at the placement of the weakened location. By weakening the rail member, the weakened location increases the probability that the rail assembly will fail or break at that predetermined location on impact by a vehicle on a the vehicle barrier system, assisting in absorbing the impact. A weakened location may be located on the side of the rail member facing an area used by vehicles, as depicted by weakened location 236, on the side facing the support members as depicted by weakened location 233, or on both sides.

In the embodiment of FIG. 2, weakened locations 233 and 236 are depicted as being substantially aligned with, and opposite to, each other. In other embodiments, multiple weakened locations may be offset from each other such that a weakened location located on one side of the rail member is not aligned with, or opposite to, a weakened location on an opposite side of the rail member. A weakened location may be located anywhere along the rail member 223 depicted in FIG. 2, or in rail members of rail assemblies without an anchor, in which case the weakened location may be at any location. A weakened location need not be included in every rail member 223 of a rail assembly. A weakened location may be included in some, but not all, rail members 223 of a rail assembly 220, or in none at all.

Whether to include one or more weakened locations in a rail member will depend upon the purpose and application of the vehicle barrier system and the type of vehicle intended to be constrained by the system. If included, a weakened location may take the form of a cut in one or more of the x, y and/or z planes of a rail member. A weakened location may extend all the way through the face/depth or the full height of a rail member, or may take the form of a partial cut along a plane or multiple planes of a rail member. Alternatively, instead of a cut, a weakened location may take the form of a punch line, kerf, scoring, void, saw cut or a composite area such as a voided region in the rail member filled with a material. In another embodiment, a weakened member may simply take the form of an area in a rail member having a reduced dimension as compared to the adjacent area of the rail member. In yet another exemplary embodiment, a weakened member may take the form of one or more holes formed in the rail member, extending either partially or completely through the rail member.

In one embodiment, the rail assembly 220 may be coupled to one or a plurality of support members 210, for example the support members 210 *a, b*, via the splice plate 100. In the embodiment of depicted in FIG. 2, the support members 210 are posts with a substantially vertical orientation. The lower portion of the support members 210 *a, b* may be buried in the earth. In other embodiments, the lower portion of support member 210*a* may be inside a sleeve 212. In other embodiments, combinations of sleeved and unsleeved support members 210 can be used. The use of sleeves 212 may add additional strength to the support member 210 and their use will depend on the support member location, use and the material in which the support member is placed.

Support members 210 may be composed of, but are not limited to, any one or more of, a metal, wood or composite posts, concrete, wood or polymeric blocks, a permanent or modular highway divider, or a wall (for example, a concrete highway wall, or a wall of a building or other structure), or a natural structure (for example, a rock or a tree).

Additionally, vehicle barrier system or assembly 200 may comprise an anchor 240 coupled to the rail assembly 220 and an anchor tension loading member 242 coupled to the anchor 240 at one end and to a support member, such as an end support member 210*a*, at the other end. The anchor 246 and anchor tension loading member 242 are operative to add tension and strength to the rail when the rail is impacted by a vehicle downstream of the anchor. If backing member 226 is present the anchor 240 may be coupled directly to the backing member 226 of the rail assembly 220.

In one embodiment, the anchor 240 is an anchor box as depicted in FIG. 2. In other embodiments, the anchor may be at least one fastener, such as a bolt, or an anchor plate. In other embodiments, the anchor may be sized, shaped and coupled to the rail assembly differently. The size, shape and coupling may be determined based on location of the vehicle barrier, the types of vehicles that might impact the vehicle barrier, and/or the size of the rail assembly.

In one embodiment, the anchor tension loading member 242 may be a cable. In other embodiments, the anchor tension loading member may be a channel, angle iron or a bar.

Figure 5:
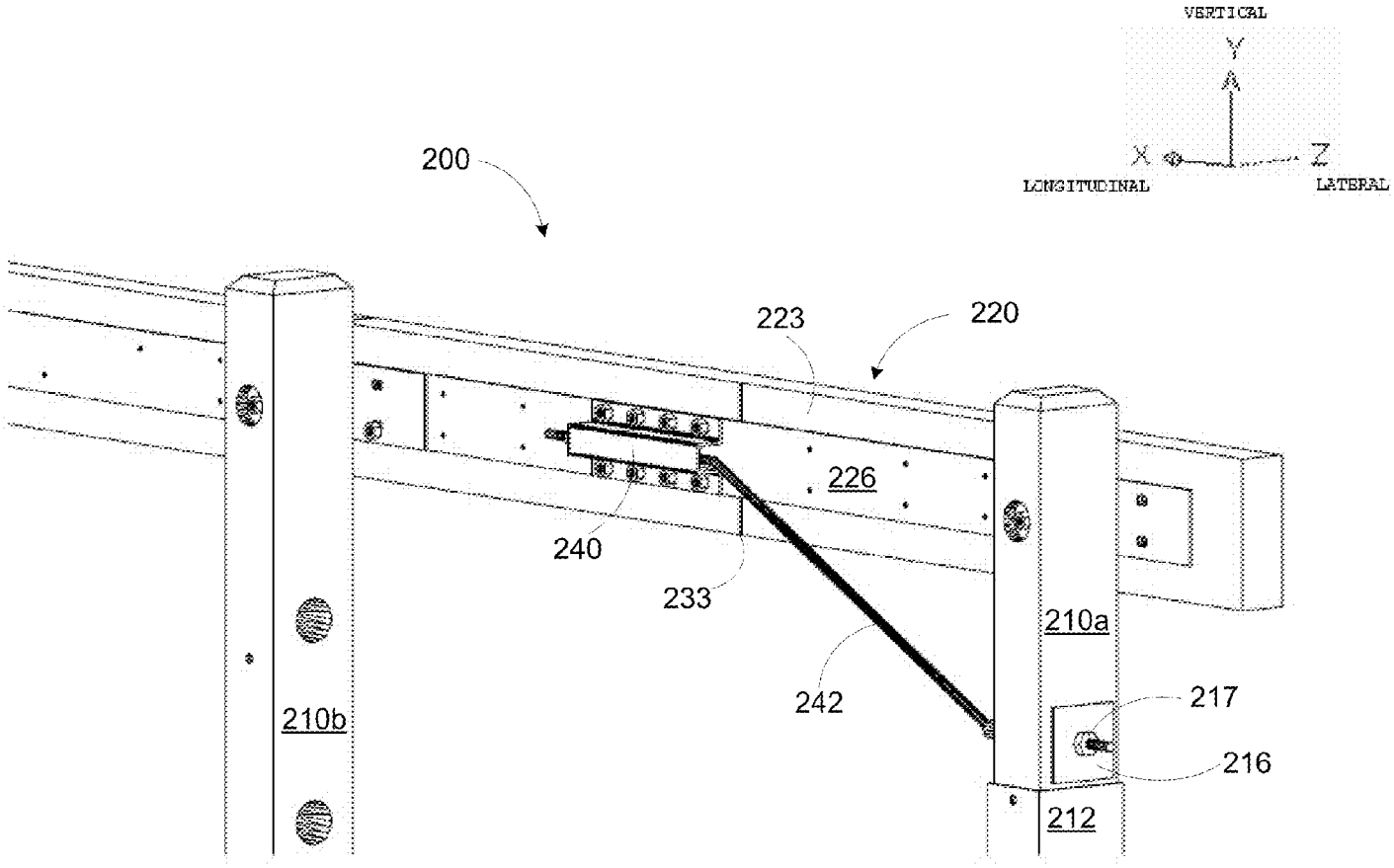
FIG. 5 is another view of the vehicle barrier system of FIG. 2.

As illustrated in FIG. 5, the anchor tension loading member 242 may be coupled to an end support post 210*a* using a bearing plate 216 and/or washer with a nut 217, but in other embodiments it may be a composite structure or a multi-component quick-release fastener that may improve the anchor tension loading member's release performance.

The orientation of the anchor 240 and the weakened locations 233 and 236, as depicted in FIG. 2, with the weakened locations located upstream of the anchor, between the anchor and the support member 210*a*, is representative of one embodiment. In other embodiments the weakened location or locations may be anywhere downstream of the anchor (for example, between anchor 240 and support member 210*b*, or even on the opposite side of support member 210*b*) or proximate between the beginning and end of the anchor to rail attachment. In yet further embodiments, weakened locations may be omitted entirely.

Figure 3:
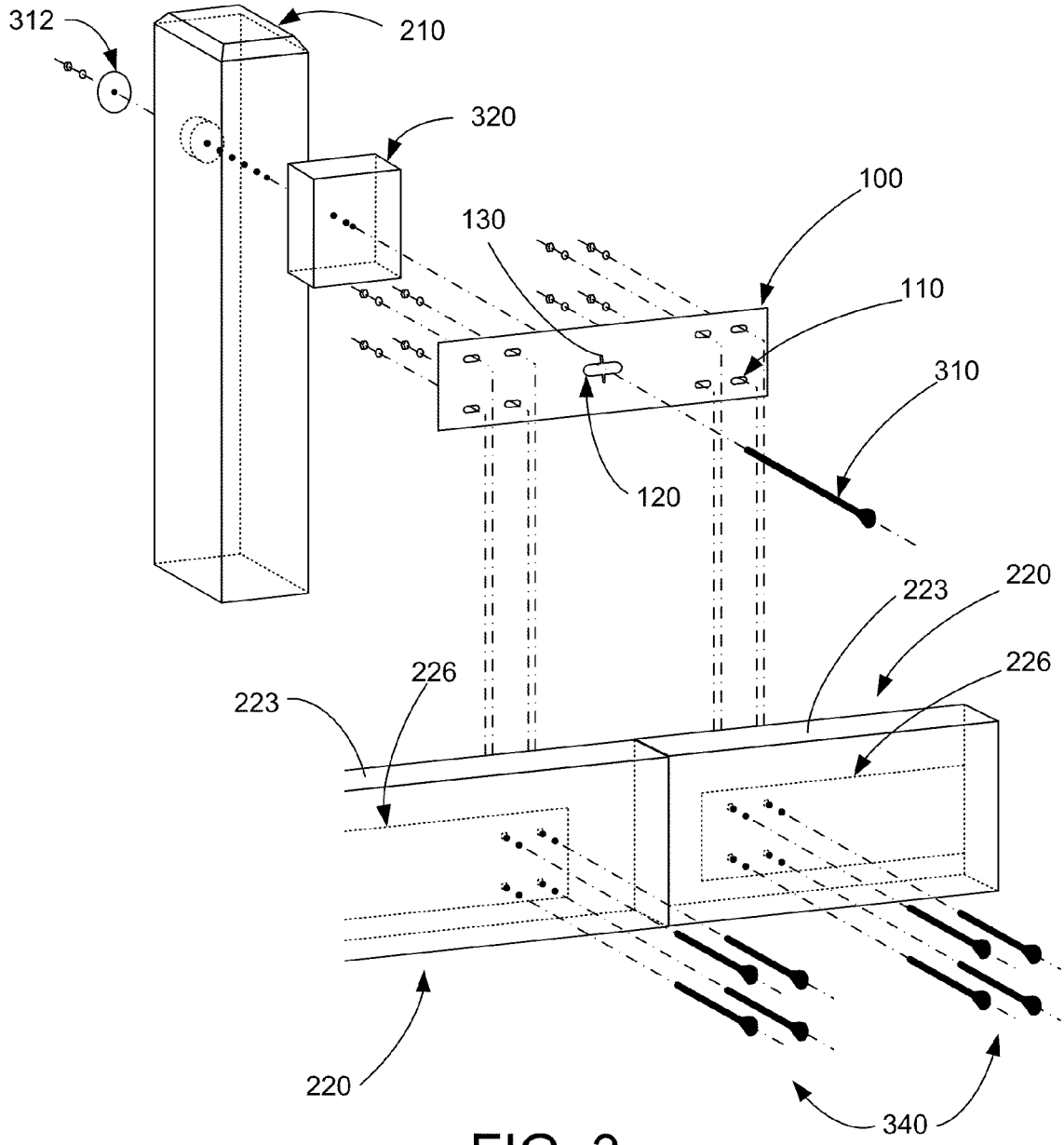
FIG. 3 is an exploded view of a rail assembly and support member junction of the vehicle barrier system of FIG. 2 in accordance with an embodiment of the present disclosure.

The vehicle barrier systems of the present disclosure may incorporate one or more support member junctions. Referring now to FIG. 3, an exemplary support member junction may be comprised of one or more rail assemblies 220, a support member 210, a splice plate 100, one or more spacers 320, one or more rail fasteners 340 and one or more support fasteners 310. Splice plate 100 may coupled to support member 210 with a fastener 310. In coupling the support member 210 and splice plate 100, a fastener 310 such as, but not limited to a bolt, wood screw or lag screw may be used. In the depicted embodiment the support fastener 310 passes though the support aperture 120 of splice plate 100, the spacer 320 and the support member 210. In one embodiment, one or more washers 312 may be used on the back side of a support member 210 in order to spread the load over a larger area, this will reduce the chances of the support fastener 310 pulling through the support member 210. In other embodiments, spacer(s) 320 may not be used. In still other embodiments the spacer(s) may be made of materials including, but not limited to, metal, wood, composites, or blocks (e.g., concrete or wood blocks).

Figure 4:
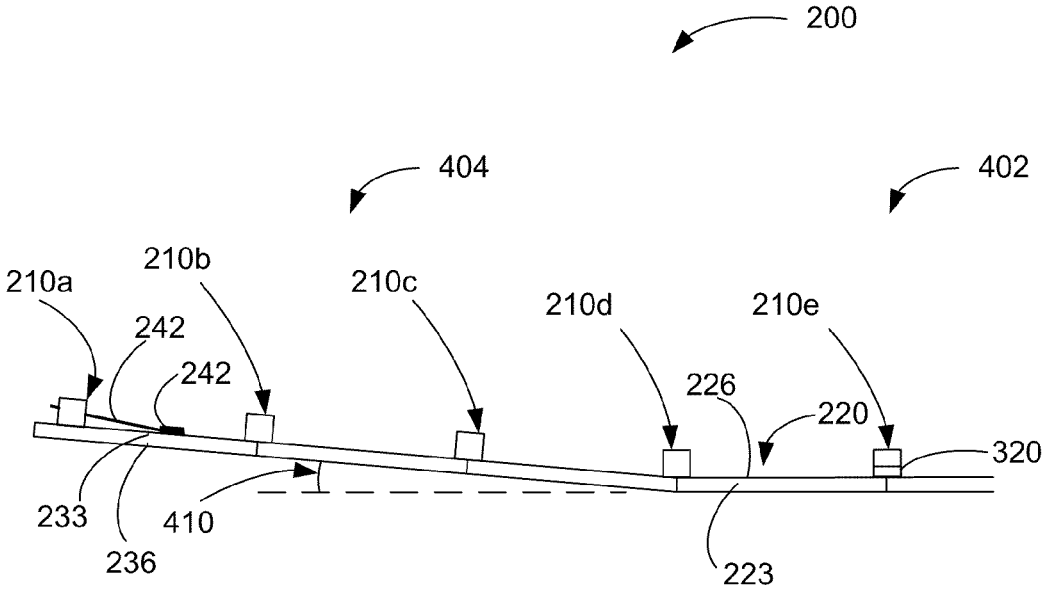
FIG. 4 is a plan view of an end treatment of the vehicle barrier system of FIG. 2 in accordance with an embodiment of the present disclosure.

One or more rail assemblies 220 may be coupled to the splice plate 100 using one or more fasteners, such as rail fasteners 340. The rail fasteners 340 pass though the rail assembly 220 and rail apertures 110 in the splice plate 100. In one embodiment, four fasteners may be used to couple each end of a rail assembly. In other embodiments more or fewer fasteners may be used. Additionally, FIG. 3 depicts a splice connection coupled with the ends of two rail assemblies 220. In other embodiments, the splice connection may be coupled to only one rail assembly, such as at the end of a vehicle barrier (as depicted in FIGS. 4 and 5) or where the distance between support members is less than the length of the rail assemblies. The backing members 226 of two different rail assemblies may also overlap such that rail fasteners 340 pass through the backing members of two rail assemblies.

In other embodiments vehicle barrier system installation may be constrained such that support members must be placed further apart. In other embodiments, rail assemblies may include multiple rail members and multiple backing members coupled to each other and a splice plate may couple the end of one of the rail assemblies to the end of another of the rail assemblies, but may not be coupled to a support member. This embodiment may be use where vehicle barrier installation is constrained such that support members must be placed further apart and the distance between support members is further than the length of one rail assembly.

Referring now to FIG. 4, a plan view of an end treatment of the vehicle barrier system 200 of FIG. 2 in accordance with an embodiment of the present disclosure. The vehicle barrier system 200 may include a center assembly 402 and an end assembly 404. The center assembly may be further comprised of rail assemblies (e.g., rail assembly 220), coupled to splice plates (e.g., splice plate 100) which may be coupled to support members (e.g., support members 210*d* and 210*e*) with or without spacers (e.g., spacer 320). In the present embodiment, the support members 210*d* and 210*e* may be coupled to the rail assemblies 226 as depicted in FIG. 3, above. The center assembly 402 substantially follows the edge of an area for vehicles thereby reducing the probability that a vehicle will leave the area used by vehicles. Vehicles include, but are not limited to, trucks, cars, other automobiles, golf carts, and motorcycles. An area used by vehicles includes roadways, highways, residential, commercial and industrial driveways, parking lots, parking decks and golf courses. A center assembly 402 may be coupled to an end assembly 404 and they may be coupled to the same support member (e.g., support member 210*d*).

End assembly 404 may include one or more rail assemblies (e.g., rail assembly 220), a plurality of support members (e.g., support members 210 *a, b* as depicted in FIG. 2, or support members 210*a-d* as depicted in FIG. 4), one or more anchors 240 and associated anchor tension loading member 242. The rail assemblies 220 and support members may be coupled together as depicted in FIG. 3, above. Additionally, the anchor 240 and the anchor tension loading member 242 may be arranged and coupled as depicted in FIG. 2.

In one embodiment, the end assembly 404 may be set back at an angle 410 with respect to the center assembly 402. The setback may reduce the probability of a vehicle hitting the end support member 210*a* head on and increases the likelihood that a vehicle will impact the rail barrier system. The angle at which the end assembly is setback may be determined by the type of road (for example, paved, gravel or dirt), road vehicle type usage rates/volumes, road speed, lane width, and/or site conditions or limitations. While the setback angle can vary from 0° to 90°, it typically may be 45° or less. In an exemplary embodiment, the set back angle may be approximately seven degrees from the center assembly.

An exemplary embodiment of a vehicle barrier system may thus include one or more rail assemblies (e.g. rail assemblies 220) coupled to one or more steel splice plates (e.g. splice plate 100) which may then be coupled to a plurality of support posts (e.g. support members 210). The rail assemblies can include wood rail members optionally coupled to steel backing rails. The steel splice plates each include a support aperture with one or more stress concentrators associated with, adjacent to, or in communication with the support aperture, and coupled to at least one of the support posts at the support aperture.

In this embodiment the system also includes a center assembly 402 and an end assembly 404. The center assembly 402 of the vehicle barrier system may be substantially parallel to a roadway while the end assembly 404 of the vehicle barrier system includes a plurality of support posts that may be placed such that the end of the vehicle barrier system is angled away, or set back, from the roadway at an angle with respect to the center assembly 402.

This exemplary embodiment may also include an anchor box 240 located between the end post (such as end post 210*a* of FIG. 4) and the second post from the end (such as post 210*b* of FIG. 4). The anchor box 240 may be coupled to the rail assembly and an anchor tension loading member 242 may be coupled to the anchor box and the end support post. Additionally, weakened locations (e.g. weakened locations 233, 236), for example kerfs, may be located in opposite sides of the wooden rail member between the end post and the anchor box.

In exemplary operation a vehicle impacts the center assembly 402. Upon impact the rail assembly 220 begins to flex and deform as the rail assembly 220 transfers force to the splice plate 100. As the force increases the splice plate pulls against the fastener 310 that couples the splice plate 100 to the associated support post. The splice plate 100 may deform around the support aperture 120, the deformation being aided by one or more stress concentrators 130 about the aperture 120, absorbing energy. Eventually the splice plate 100 may pull away from the support fastener 310 and post 210, the support fastener pulling through the support apertures aided by the associated stress concentrator. Additional splice plates 100 upstream and/or downstream along the rail assembly may also pull away from their associated support posts, if the forces are high enough. As the rail assembly continues to deform, the anchor box 240 and anchor tension loading member 242 (for example, a cable) will supply tension to the rail assembly and transfer some of the load to the base of the first support post in the system (e.g., the end post 210*a* of FIG. 4). In this way the energy of an impacting vehicle may be absorbed and vehicle progress may be stopped.

In another exemplary operation, a vehicle impacts the end post (e.g., end post 210*a* of FIG. 4). Upon impact the end post fractures, releasing attachment of the tension loading member 242, for example, an anchor cable. As the vehicle continues to move forward along the vehicle barrier system the rail assembly 220 of the end assembly 404 begins to flex and deform. If the impact transfers a large amount of energy to the rail assembly 220 of the end assembly 404, one or more weakened locations in the rail member 223 may cause the rail member 223 to fail or fracture allowing the vehicle to move further into the vehicle barrier. In one embodiment, the weakened location(s) are placed only in the first, most distal rail member 223 (located, for example between post 210*a* and post 210*b* of the system depicted in FIG. 4). Additional energy may be absorbed if the splice plate 100 associated with, for example post 210*b* of FIG. 4, deforms around the support aperture 120, the deformation being aided by one or more stress concentrators 130 about the support aperture 120. Eventually the splice plate 100 may pull away from its associated support fastener 310 and post 210*b*. As the vehicle continues into the barrier additional posts 210 and rail members 223 upstream of the vehicle and interior from post 210*b* may fracture and splice plates may be pulled from additional posts until the vehicle is brought to a stop. The weakened locations in the rail member(s) in combination with the rail members being coupled to the backing members 226 may cause the rail members 226 to fracture in such a way that the hazard to people and vehicles, caused by debris from the fractured rail members, may be reduced or eliminated.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, at least the following is claimed:

1. A vehicle barrier system, comprising:

a support member having a first side adapted for disposition toward an area used by vehicles;

a splice plate including a support aperture and a stress concentrator associated with the support aperture; and a rail assembly including a rail member and having a first side;

wherein the first side of the rail assembly is coupled to the splice plate and the splice plate is coupled to the support member at the support aperture.

2. The vehicle barrier system of claim 1, wherein the rail assembly includes a backing member disposed on the first side of the rail assembly.

3. The vehicle barrier system of claim 1, wherein the rail assembly is composed of wood and includes a backing member disposed on the first side of the rail assembly.

4. The vehicle barrier system of claim 1, the rail member having a first end and a second end opposite its first end and including a weakened location in between the first end and the second end of the rail member.

5. The vehicle barrier system of claim 2, the rail member having a first end and a second end opposite its first end and including a weakened location in between the first end and the second end of the rail member.

6. The vehicle barrier system of claim 3, the rail member having a first end and a second end opposite its first end and including a weakened location in between the first end and the second end of the rail member.

7. The vehicle barrier system of claim 2, wherein the backing member is composed of one or more of a metal, wood, a polymeric material, a steel reinforced material, a banded material or a fiber composite material.

8. The vehicle barrier system of claim 1, wherein the rail member is composed of one or more of wood, timber, synthetic wood, plastic, concrete, resin reinforced composite or a metal.

9. The vehicle barrier system of claim 1, wherein the rail is composed of wood.

10. The vehicle barrier system of claim 1, wherein the area used by vehicles is a roadway.

11. The vehicle barrier system of claim 2, wherein the backing member is coupled to the rail member.

12. The vehicle barrier system of claim 1, wherein the support member is a post.

13. The vehicle barrier system of claim 1, wherein the support member is composed of one or more of a metal, wood or composite post, a concrete, wood or composite block, a permanent or modular highway divider, a wall, or a natural structure.

14. The vehicle barrier system of claim 1, wherein the stress concentrator is in communication with the support aperture.

15. The vehicle barrier system of claim 1, wherein the splice plate is composed of one or more of a metal, wood, a polymeric material, a steel reinforced material, a banded material, or a fiber composite material.

16. The vehicle barrier system of claim 1, wherein the support member is composed of wood.

17. The vehicle barrier system of claim 1, wherein the support member and the rail member are comprised of wood and the rail assembly includes a backing member disposed on the first side of the rail assembly.

18. A vehicle barrier system, comprising:

a first support member and a second support member, each having a first side adapted for disposition toward an area used by vehicles;

a rail assembly including a rail member and having a first side, the rail member having a first end and a second end opposite its first end and including a weakened location in between the first end and the second end of the rail member;

wherein the first side of the rail assembly is coupled to the support members, and wherein the rail member is composed of wood, the system further comprising a splice plate including a support aperture and a stress concentrator associated with the support aperture, wherein the rail assembly is coupled to the splice plate, and the splice plate is coupled to one of the first or second support members at the support aperture.

19. The vehicle barrier system of claim 18, wherein the rail assembly includes a backing member disposed on the first side of the rail assembly.

20. The vehicle barrier system of claim 18, wherein the rail assembly is composed of wood and includes a backing member disposed on the first side of the rail assembly.

21. A vehicle barrier system including an end assembly, the end assembly comprising:

a first support member;

a second support member;

a wooden rail assembly including a wooden rail member, having a first side and having a first end and a second end opposite its first end;

an anchor coupled to the wooden rail assembly between the first end and the second end of the wooden rail assembly; and an anchor tension loading member with a first end coupled to the anchor and a second end coupled to the first support member;

the wooden rail assembly being coupled at or near its first end to the first support member and at or near its second end to the second support member, the wooden rail member providing the only connection between the first support member and the second support member, wherein the end assembly further comprises;

a splice plate including a support aperture and a stress concentrator associated with the support aperture, the splice plate coupled at the support aperture to one of the support members, the wooden rail assembly being coupled to the splice plate therewith being coupled to said one of the support members.

* * * * *